US005299699A

United States Patent [19]

Cole

[11] Patent Number: 5,299,699

[45] Date of Patent: Apr. 5, 1994

[54] DEVICE AND METHOD FOR TEMPORARY STORAGE AND TRANSPORT OF FINISHED PARTS

[76] Inventor: Joseph Cole, 810 Garfield Ave., Bridgewater, N.J. 08870

[21] Appl. No.: 870,810

[22] Filed: Apr. 20, 1992

Related U.S. Application Data

[63] Continuation of Ser. No. 610,214, Nov. 6, 1990.

[51] Int. Cl.[5] ..... A47F 5/08

[52] U.S. Cl. ..... 211/187; 211/89; 280/79.3; 108/60

[58] Field of Search ..... 211/187, 186, 184, 134, 211/133, 40, 594, 89; 108/60; 410/39, 40; 280/79.3

[56] References Cited

U.S. PATENT DOCUMENTS

| | | | |
|---|---|---|---|
| 72,851 | 4/1903 | Kopp | 280/793 X |
| 2,491,652 | 12/1949 | Feerick | 211/184 X |
| 2,721,662 | 10/1955 | Miller | 280/79.3 |
| 2,825,465 | 3/1958 | Burgo | 211/40 |
| 3,007,708 | 11/1961 | Ochs . | |
| 3,216,587 | 11/1965 | Anders | 211/184 |
| 3,580,602 | 5/1971 | Hebert .. | |
| 3,760,154 | 9/1973 | Konger . | |
| 3,908,831 | 9/1975 | Brendford . | |
| 4,159,831 | 7/1979 | Schorr . | |
| 4,166,589 | 9/1979 | Hoover et al. . | |
| 4,326,726 | 4/1982 | Dunchock | 280/79.3 |
| 4,458,467 | 7/1984 | Shulman et al. . | |
| 4,499,706 | 2/1985 | Scheller . | |
| 4,535,897 | 8/1985 | Remington et al. . | |
| 4,559,762 | 12/1985 | Soltus et al. . | |
| 4,588,096 | 5/1986 | Story et al. . | |
| 4,607,476 | 8/1986 | Fulton, Jr. . | |
| 4,631,898 | 12/1986 | Brambilla . | |
| 4,720,048 | 1/1988 | Maroney et al. . | |

*Primary Examiner*—Blair M. Johnson
*Attorney, Agent, or Firm*—Alan R. Thiele

[57] ABSTRACT

A device and method for receiving, transporting and positioning parts such as covers or frames for computer includes a cart having a plurality of substantially horizontal shelves. The horizontal shelves are constructed so as to receive and hold the parts in position for easy transport.

7 Claims, 3 Drawing Sheets

DEVICE AND METHOD FOR TEMPORARY STORAGE AND TRANSPORT OF FINISHED PARTS

This application is a continuation of U.S. application Ser. No. 07/610,214, filed Nov. 6, 1990.

BACKGROUND OF THE INVENTION

The device and method of the present invention relates to receiving, transporting and positioning parts; more particularly, the device of the present invention allows for the receiving, transporting, and positioning of finished parts to be used later in an assembly line.

Sheet metal parts, particularly those used in computers, are painted with a coating after being fabricated. Computer assembly factories do not often include sheet metal bending operations; therefore, the coated sheet metal parts for a computer are typically purchased from a sheet metal fabricator and transported from a factory located at a distance away from the computer assembly facility.

In order to prevent the painted sheet metal parts from being damaged during transport, it has become customary to package the sheet metal parts in a plastic bag and then insert the bagged parts into a cardboard container. These cardboard containers are then placed in a larger container and the larger container is then loaded in the back of a truck. The truck is then taken to the place for computer assembly and the large containers unloaded.

Once the large containers are unloaded and opened, the smaller containers holding the sheet metal parts are then opened and the bagged sheet metal parts are removed. Before assembly of the parts into the computer, the bags must be removed. It is readily apparent that this system produces a lot of waste. Specifically, such waste includes the plastic bags in which the devices are placed, the cardboard boxes which surround the plastic bags and the large cardboard boxes in which the smaller boxes are packed. Additionally, the bagging, boxing and unboxing of the parts creates a significant amount of overhead for both the sheet metal fabricator and the computer assembler. This overhead is then passed on the customer, thus increasing the cost of computers.

In addition, there is a current trend in manufacturing engineering to provide parts to an assembly line "just in time" in order to reduce the cost of storage. In order to provide parts "just in time", it is necessary that smaller quantities of parts be provided at the same rate that they are used in an assembly line. Accordingly, there is a need in the art for a simplified system to provide parts to an assembly line on a "just in time" basis. Such system should also include means for protecting the parts from damage, minimizing waste and reducing overhead.

SUMMARY OF THE INVENTION

A device and method for receiving, transporting and positioning parts to be used as part of a larger assembly or on an assembly line is built upon a moveable base member. The device consists of a plurality of substantially horizontal shelf members which are mounted on vertical supports emanating upwardly from the moveable cart. These substantially vertical shelf members are formed so as to make spaces for finished or painted parts, such as frames or covers for computers. The spaces in which the frames or covers for computers are positioned include compresible padding so as to not damage the exterior surface of the parts. Further separating the spaces for receiving and positioning the parts are flexible vertical straps.

Once the parts have been loaded on the cart, the cart and parts may be wrapped with a shrink wrap film and loaded on a transport vehicle. The combination cart and part system may then be transported to an assembly facility where the cart is unloaded from the transport vehicle. The shrink wrap film need only be removed and the cart positioned near an assembly line wherein the parts are ready for inclusion in a larger assembly such as a computer.

BRIEF DESCRIPTION OF THE DRAWINGS

A better understanding of the device and method of the present invention may be had by reference to the figures wherein.

BRIEF DESCRIPTION OF THE EMBODIMENTS

Figure 2:
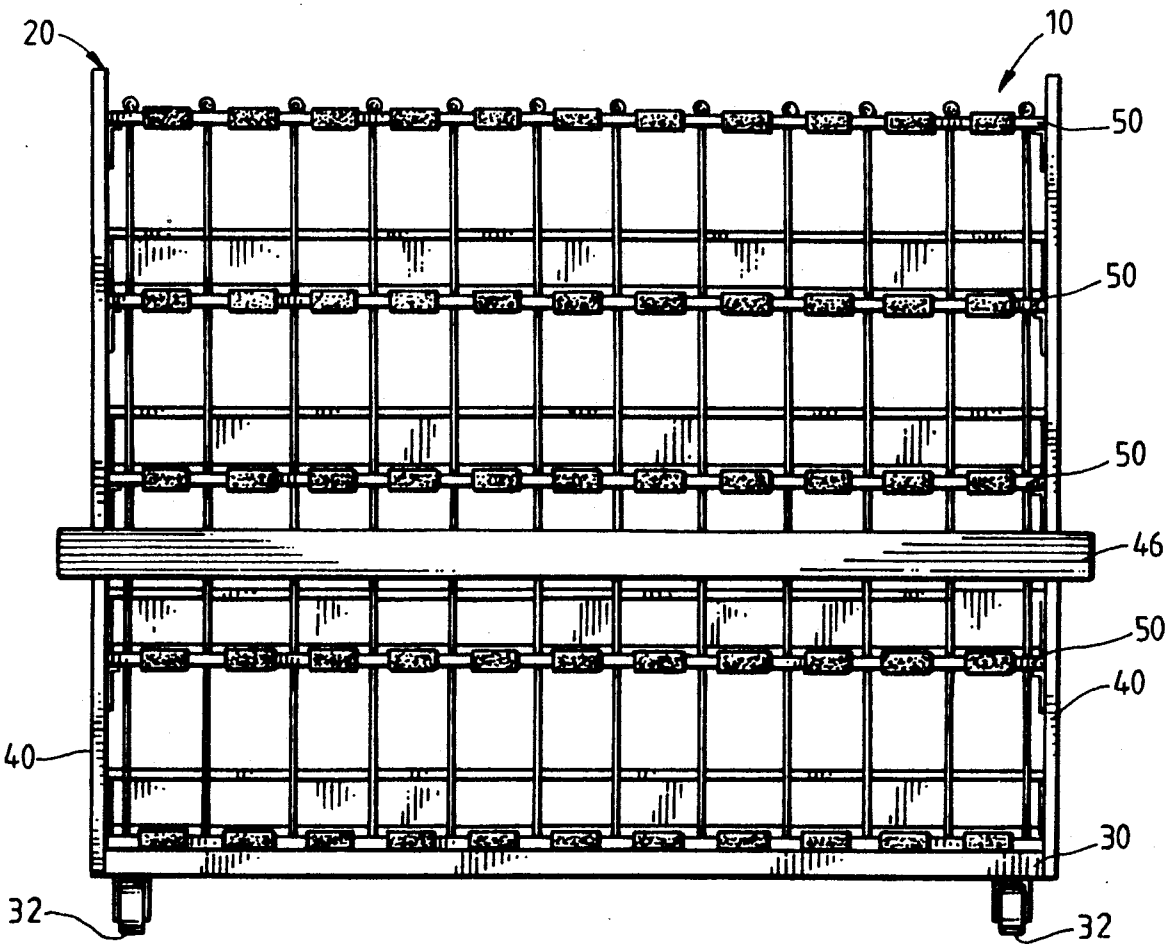
FIG. 2 is a side elevational view thereof.
Figure 1:
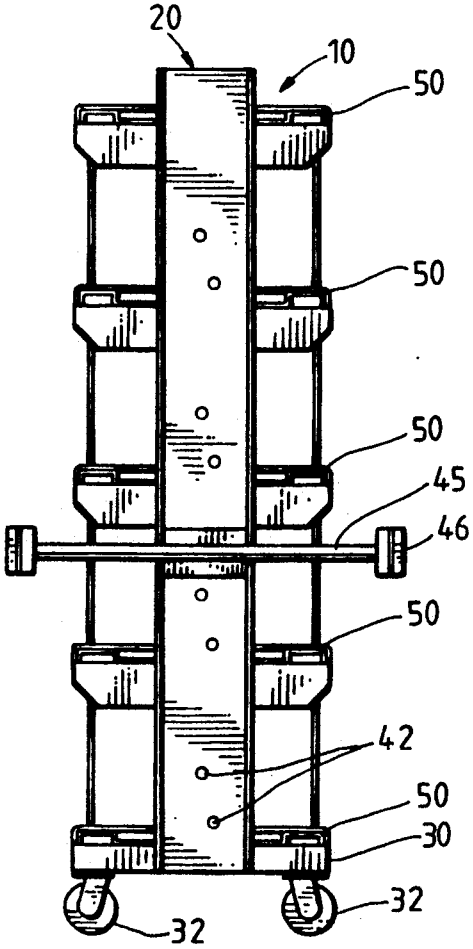
FIG. 1 is an end view of the part receiving, transporting and positioning system of the present invention.

A better understanding of the device 10 and method of the present invention may be had by reference to the figures. Therein it may be seen by reference to FIGS. 1 and 2 that the device 10 and system of the present invention is centered about, generally, a cart 20. Cart 20 is built upon a rectangular base 30 which, in the preferred embodiment, is mounted upon wheel members 32. While wheel members 32 are shown in the preferred embodiment, it will be understood that wheel members 32 are not necessary for the operation of the device as the device may be lifted with a fork lift.

Figure 3:
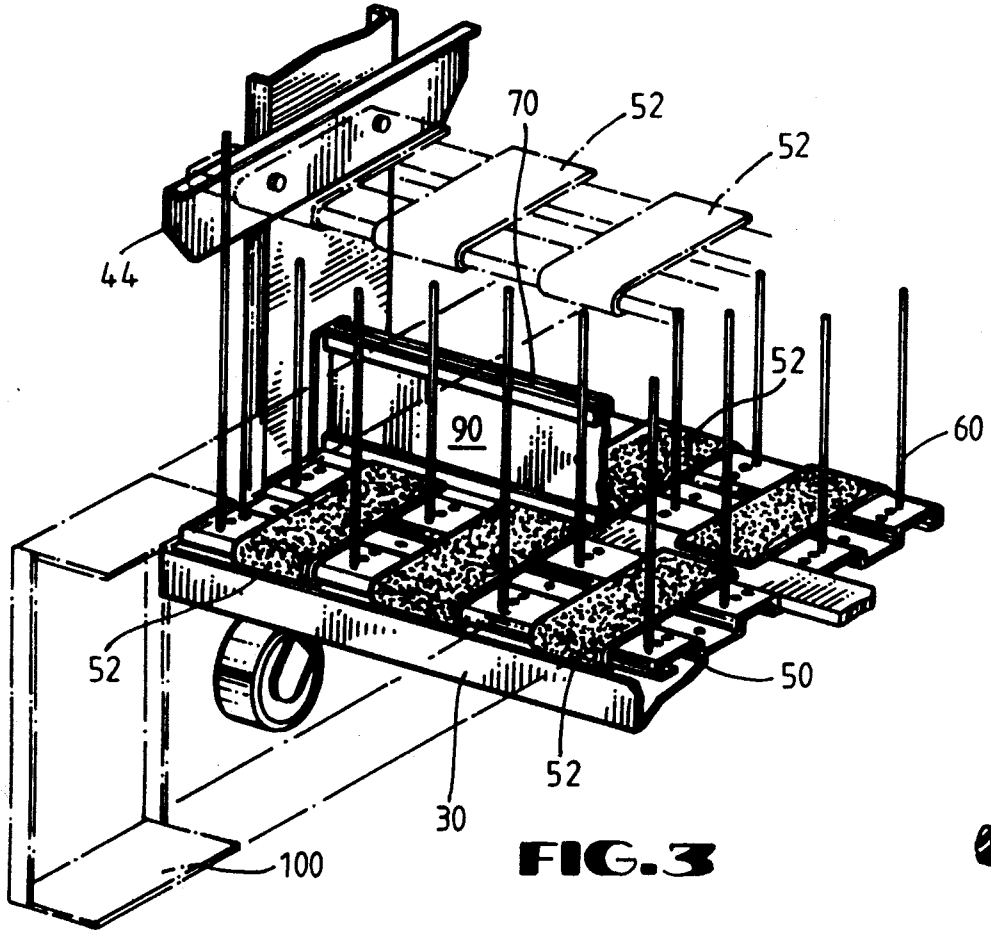
FIG. 3 is a detail view showing the insertion of a part into the system for receiving and transporting parts.

Mounted to rectangular base 30 are two substantially vertical upright members 40. Vertical upright members 40 include a plurality of holes 42 for mounting substantially horizontal shelf members 50. As may be seen in FIG. 3, shelf members 50 are attached to vertical upright members 40 by the use of angle brackets or shelf support members mounted on the underside of the substantially horizontal shelf members 50. Substantially horizontal shelf members 50 are vertically positioned on vertical upright members 40 so as to enable the insertion of finished parts 100, such as computer covers or frames as shown in phantom, to be positioned by the substantially horizonal shelf members are shown in FIG. 3.

To protect parts 100, substantially horizontal shelf members 50 may be padded over and under with pieces of carpeting or soft material 52 to prevent the painted outside surfaces of the parts from becoming scratched or damaged.

Figure 4:
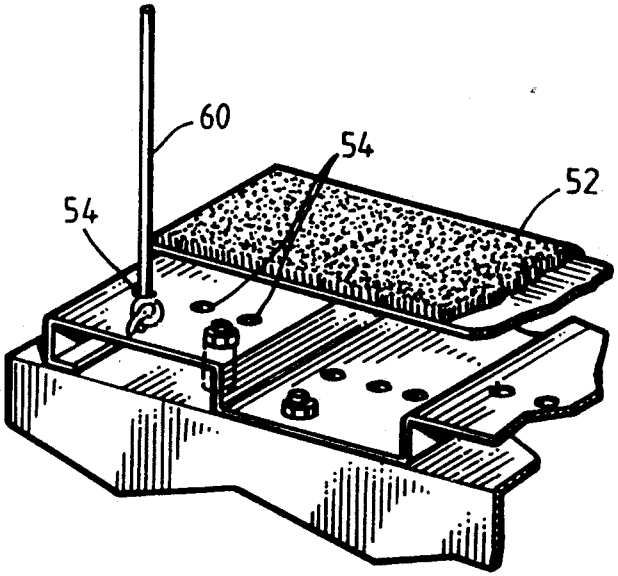
FIG. 4 is a detail of the mounting of the lower shelf members.
Figure 5:
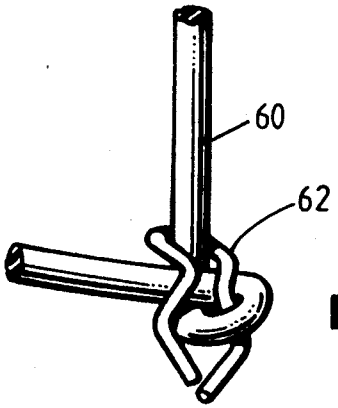
FIG. 5 is a detail of the mounting of the flexible vertical strap members.

To separate the various positions in which the parts are located, a series of flexible strap members 60 may be used. In the preferred embodiment and as shown in FIG. 4, these flexible strap members 60 are conducted vertically through holes 54 in substantially horizontal shelf members 50 and affixed thereto through the use of a clip 62 as shown in FIG. 5.

In the preferred embodiment, cart 20 of the present invention is symmetrical about a substantially vertical axis. Accordingly, parts 100 such as covers or frames may be inserted from either the left or right side of cart 20. To prevent parts 100 from contacting one another and thus damaging their exterior surfaces, a spacer 70 may be used in the middle of the cart 20 as shown in FIG. 3. To facilitate transport of cart 20, a handle 45 may be placed on one or both ends of cart 20. Handle 45 may be used to push cart 20 and position it against a wall and/or a transport vehicle (not shown). To further protect cart 20 and parts 100 from damage, a bumper member 46 may be placed along the side of cart 20. Such bumper member 46 may be a piece of wood or shock absorbing material. Operation.

In order to utilize the device 10 and system of the present invention, substantially horizontal shelf members 50 must first be positioned along vertical supports 40 so as to accommodate finished parts 100. The plurality of holes 42 formed on vertical supports 40 allows a wide variety of positions to be achieved by substantially horizontal shelf members 50 between said padding pieces. Substantially horizontal shelf members 50 are positioned a sufficient distance apart to allow for a slidable retention of parts 100 as they are placed therein.

Flexible vertical strap means 60 are laced through holes 54 in substantially horizontal shelves 50 in such a manner so as to form a space 90 in which parts 100 may be inserted and to protect adjacent parts should one fall towards another.

Figure 6:
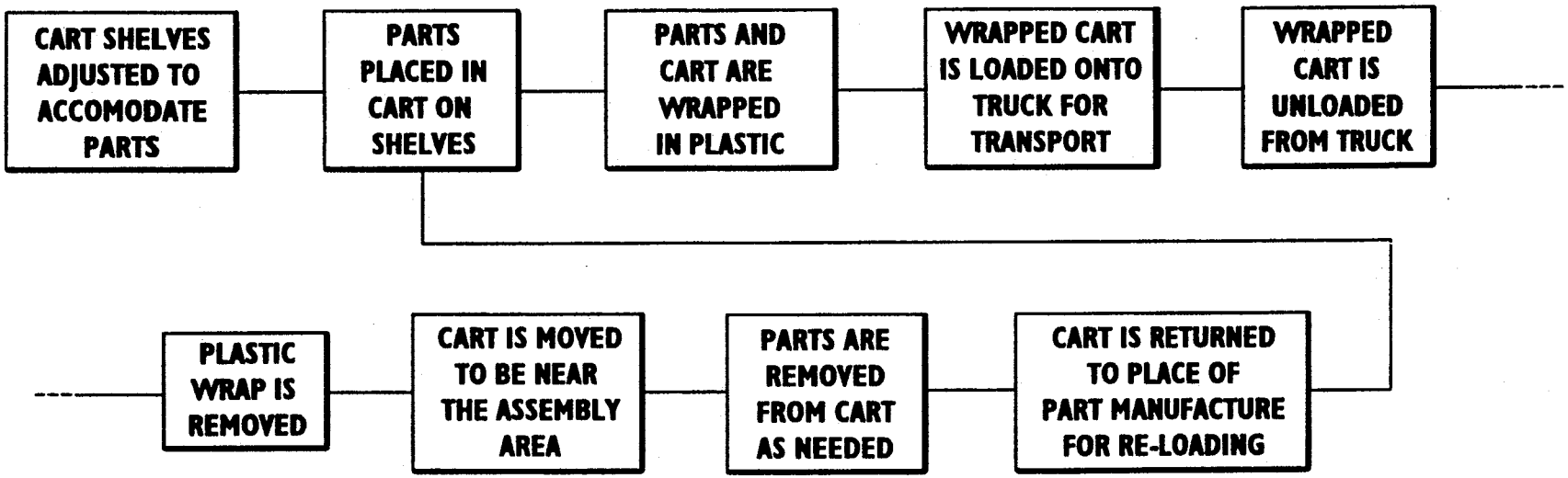
FIG. 6 is a schematic drawing of the steps involved in utilizing the device of the present invention.

The steps for utilizing the device 10 and system of the present invention are best understood by reference to FIG. 6. Once cart 20 has been loaded with finished parts 100, it is completely wrapped in a shrink wrap plastic (not shown). Cart 20 is then loaded on to a transport vehicle such as a semi-trailer and, if desired, lashed to the side or base of the trailer. Carts 20 and completed parts 100 are then transported to a factory wherein computers or other devices are to be assembled utilizing the parts contained on the part cart. The shrink wrap is then taken from part cart 20 and part cart 20, with parts 100 included thereon, is then rolled to the assembly line. Parts 100 are removed from cart 20 by the assembly line workers. Padding 52 on substantially horizontal shelf members 50 prevents damage to parts 100 and the organized arrangement of parts 100 enables the assembly line workers to determine how many parts are still available by counting empty spaces 90 on part cart 20. When cart 20 is emptied, it may be returned to the point of manufacture of parts 100 .and once again reloaded for eventual return to the assembly line.

There is thereby provided by the device 10 and method of the present invention a system for receiving, transporting and positioning finished parts to be used as part of a larger assembly or on an assembly line.

While the device 10 and method of the present invention has been described with reference to its preferred embodiment, it will be understood that modifications of this device may be made by those having ordinary skill in the art. Such modifications shall be included within the scope of the appended claims.

I claim:

1. A device for receiving, positioning, retaining and protecting the surface of parts, said device comprising:

a substantially rectangular base member having a width and a lenght;

two substantially vertical support members projecting upwardly from and rigidly attached to opposing ends of said substantially rectangular base member;

a plurality of substantially horizontal shelf support members adjustably positioned with respect to each of said substantially vertical support members;

means for fastening said substantially horizontal shelf support members to said substantially vertical support members;

a plurality of substantially horizontal, substantially rectangular shelf members having a width dimension, a lenght dimension, an upper surface and a lower surface, said plurality of substantially horizontal, substantially rectangular shelf members constructed and arranged to rest upon said substantially horizontal shelf support members so as to form a vertical space between the upper surface of one substantially horizontal, substantially rectangular shelf member and the lower surface of the next higher of said substantially horizontal, substantially rectngular shelf members;

said vertical space between said substantially horizontal, substantially rectangular shelf members being slightly larger than a dimension of the parts to be received, positioned, retained and protected;

a plurality of strips of compresssible padding positioned across the width and along said upper and lower surfaces of said substantially horizontal, substantially rectangular shelf members, said compressible padding having a thickness dimension sufficient to extend into said vertical space between said substantially horizontal, substantially rectangular shelf members and to make said vertical sapce slightly smaller than a dimension of the parts to be received, positioned, retained and protected;

flexible strap members projecting substantially vertically between said substantially horizontal, substantially rectangular shelf members and between said strips of compressible padding;

whereby the parts of be received, positioned, retained and protected are inserted between said subsantially horizontal, substantially rectangular shelf members and retained in positioned by compression of the srips of compressible padding which extend across the width and over the upper and lower surfaces of said substantially horizontal, substantially rectangular shelf members.

2. The device as defined in claim 1 wherein said base member further includes a plurality of wheel members.

3. The device as defined in claim 1 wherein said device is symmetrical about a vertical plane.

4. The device as defined in claim 3 further including substantially vertical spacers lying along said vertical plane.

5. A device for protecting te surface of painted sheet metal covers or frames for computers while in transport from the place of frame or cover manufacture to the pace of computer assembly, said device comprising:

a rectangular base member having a width and a length, said rectangular base member including a plurality of wheel two substantially vertical support members projecting upwardly from and rigidly attached to opposing ends of said substantially rectangular base member;

a plurality of substantially horizontal shelf support members adjustably positioned with respect to each of said substantially vertical support members;

means for fastening said substantially horizontal shelf support members to said substantially vertical support members;

a plurality of substantially horizontal, substantially rectangular shelf members having a width dimension, a length dimension, an upper surface and a lower surface, said plurality of substantially horizontal, substantially rectanguarl shelf members constructed and arranged to rest upon said substantially horizontal shelf support members so as to form a vertical sapce rectangular shelf member and the lower surface of the next higher of said substantially horizontal, substantially rectangular shelf members;

said vertical space between said substantially horizontal, substantially rectangular shelf members being slightly larger than a dimension of the painted sheet metal covers or frames for computers to be transported;

a plurality of strips of compressible padding positioned across the width and along said upper and lower surfaces of said substantially horizontal, substantially rectangular shelf members, said compressible padding having a thickness dimension sufficient to extend into said vertical space between substantially horizontal, substantially rectangular shelf members and to make said vertical space slightly smaller than a dimension of the painted sheet metal covers or frames for computers to be tansported;

flexible strap members projecting substantially vertically between said substantially horizontal, substantially rectangular shelf members and between said strips of compressible padding;

whereby the painted sheet metal covers or frames for computers to be transported are inserted between said substantially horizontal, substantially rectangular shelf members and retained in positioned by compression of the strips of compressible padding which extend across the width and over the upper and lower surfaces of said substantially horizontal, substantially rectangular shelf members and preventing from falling into one another by said flexible strap members.

6. The device as defined in claim 5 wherein said device is symmetrical about a vertical plane.

7. The device as defined in claim 6 further including substantially vertical sapces lying along said vertical plane.

* * * * *